US005185979A

United States Patent [19]

Azzimonti

[11] Patent Number: 5,185,979

[45] Date of Patent: Feb. 16, 1993

[54] ASSEMBLING SHEETS OF GLASS TO METAL STRUCTURES

[75] Inventor: Giovanni Azzimonti, Novara, Italy

[73] Assignee: Azzimonti Paolino S.p.A., Caltignaga, Italy

[21] Appl. No.: 474,792

[22] PCT Filed: Nov. 7, 1988

[86] PCT No.: PCT/IT88/00081

§ 371 Date: Jul. 9, 1990

§ 102(e) Date: Jul. 9, 1990

[87] PCT Pub. No.: WO89/04416

PCT Pub. Date: May 18, 1989

[30] Foreign Application Priority Data

Nov. 12, 1987 [IT] Italy ..... 22615 A/87

[51] Int. Cl.[5] ..... E04C 2/46

[52] U.S. Cl. ..... 52/235

[58] Field of Search ..... 52/235, 208, 510, 511, 52/483, 764, 775, 777, 780, 781

[56] References Cited

U.S. PATENT DOCUMENTS

| | | | |
|---|---|---|---|
| 3,416,833 | 6/1967 | Griffin | 52/208 |
| 3,478,475 | 11/1969 | Strack | 52/208 |
| 3,672,107 | 6/1972 | Santry et al. | 52/211 |
| 3,722,163 | 3/1973 | Satkin et al. | 52/511 |
| 4,307,551 | 12/1981 | Crandell . | |
| 4,314,424 | 2/1982 | Gordon et al. . | |
| 4,561,223 | 12/1985 | Gold et al. | 52/208 |
| 4,608,793 | 9/1986 | Yost et al. | 52/235 |
| 4,625,481 | 12/1986 | Crandell | 52/235 |
| 4,912,898 | 4/1990 | Holmes | 52/235 |

FOREIGN PATENT DOCUMENTS

| | | |
|---|---|---|
| 0153574 | 9/1985 | European Pat. Off. . |
| 297952 | 6/1988 | European Pat. Off. . |
| 0297952 | 1/1989 | European Pat. Off. . |
| 1932321 | 1/1971 | Fed. Rep. of Germany . |
| 2308457 | 8/1974 | Fed. Rep. of Germany . |
| 8701693.1 | 5/1987 | Fed. Rep. of Germany . |
| 8706742.0 | 8/1987 | Fed. Rep. of Germany . |
| 3633618 | 4/1988 | Fed. Rep. of Germany . |
| 2282033 | 3/1976 | France . |
| 2617229 | 12/1988 | France . |

*Primary Examiner*—David A. Scherbel
*Assistant Examiner*—Michele A. Van Patten
*Attorney, Agent, or Firm*—Young & Thompson

[57] ABSTRACT

This invention provides for the mechanical attachment of at least a strip (3) of glass or the like to the metal structure (1) (by using staples, for example, or other means of attachment) in such a way that the strip (3) of glass faces the area (14) where the sheet (4) of glass is fixed. The sheet (4) of glass, double or single glazed, is fixed to said strip (3) by an elastic means (5) for example silicon seals ideal for use in the normal fixing of glass to glass, Preferably, the metal structure comprises a jutting ledge (9) that acts as a support for the vertical forces acting on the sheet (4) of glass.

10 Claims, 2 Drawing Sheets

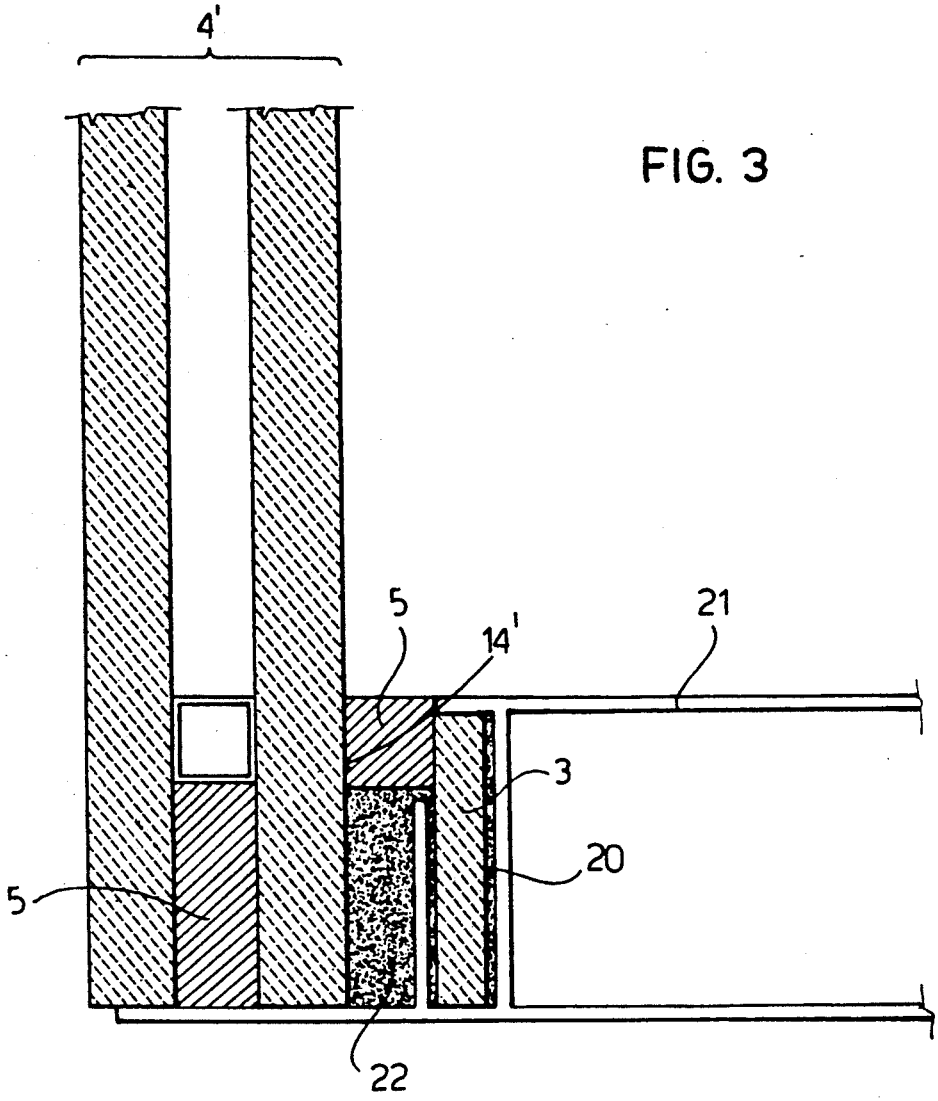
FIG. 3
FIG. 4
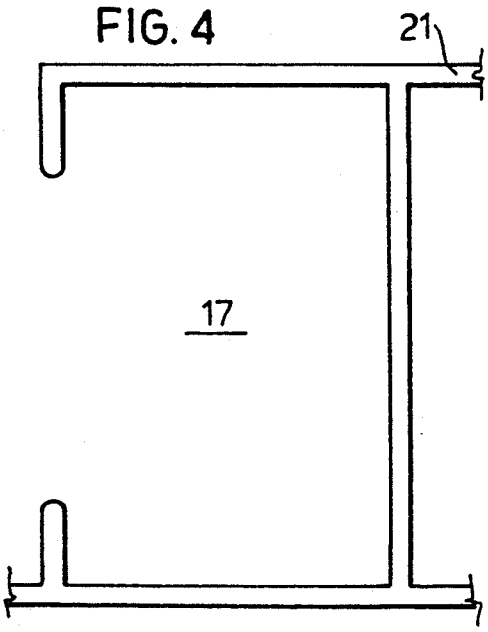
FIG. 5
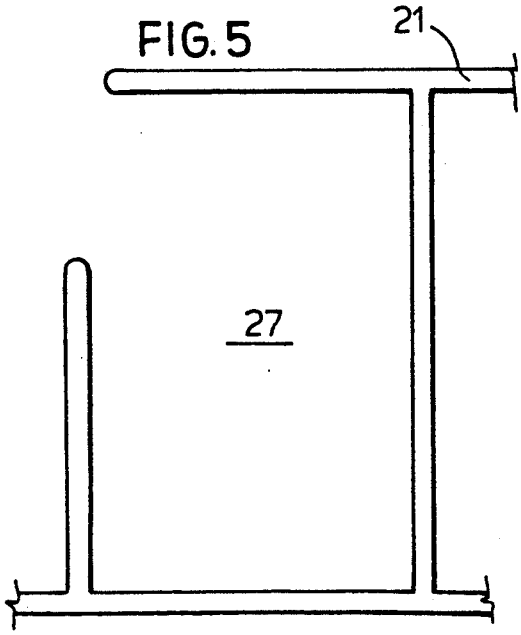

ASSEMBLING SHEETS OF GLASS TO METAL STRUCTURES

The invention concerns a process for the assembly of sheets of glass to metal structures, the means capable of assembling the aforementioned, and the assembly thus obtained.

In recent years the construction business has seen a considerable increase in the use of glass; one only has to think of the great public buildings, towers etc. with entire sides made of reflective glass. Along with this architectural evolution unfortunately problems arise in the assembly between the metal structures or frames and the sheets of glass.

At the present time it is difficult to have a safe fixing i.e. a good weatherproof adhesion which also resists for years to atmospheric agents and to the progressive pollution of the air.

A good adhesion of the glass to the metal can only be guaranteed when the metal surfaces have undergone special treatments compatible with the seal and are therefore subject to precise and severe controls. All this in the building practice results in considerably increased costs and working time, without necessarily achieving absolute safety due to the fact that the aluminium or other metal used, can be different for many reasons to the analyzed sample.

DE-A-2 308 457 teaches how to join a peripheral bead or section bar containing glass fibres, glass particles or the like to the sheet of glass, by means of glues or cement (therefore rigid adhesives). This bead is blocked in such a way to form a substantially rigid unit with the sheet of glass. However this kind of joint cannot be used in the structural glazings subject to thermal and mechanical stresses. It is furthermore difficult to handle the sheets of glass which have such a bead. Finally the fixing of the bead to iron or concrete structures is difficult, as it should allow differentiated thermal expansions between the sheet and its support.

In the structural surfaces, i.e. when the frame is hidden inside, a rigid sealing of a sheet of glass must in fact be excluded due to the lack of the necessary expansion between the sheet of glass and metal structure. Furthermore the fixing of the glass bead to the external sheet of glass, which must be the first operation to be carried out, brings considerable difficulties both in the carrying out and in the subsequent handling of the sheet. This solution is not therefore suitable for use in structural glass surfaces.

Therefore the aim of this invention is to provide a safe, simple and economic means of fastening of glass to metal structures.

The aforementioned aim has been achieved by mechanically fixing to the metal structure at least one strip of glass or the like (for example by using staples or other means of attachment) which faces outwards, positioning a sheet of double or single glazed glass so that at least a localized zone of it is facing, but at a distance from said strip of glass or the like, then inserting an elastic means between said facing surfaces, for example a silicon seal of the type already used in the manufacture of insulating double-glazed glass.

Preferably at least two parallel strips are provided for each sheet of glass, preferably four strips, applied along all the periphery of the sheet.

Preferably, the metal structure comprises a jutting horizontal ledge that acts as a support for the vertical forces acting on the sheet of glass.

The fixing of the strip of glass to the metal structure has to be such that it allows differentiated expansion and contraction due to mechanical stresses or temperature variations.

This invention foresees the insertion not only of a strip of glass, but also of any compound based on silica, fibreglass, ceramic, vitrified varnish etc. which has physical and/or chemical characteristics which are similar to those of glass. For this reason the strip has been described as made of "glass or the like".

The means capable of accomplishing the coupling of the metal structure to the strip of glass can be a series of staples made fast to the metal structure (for example, by means of lamination, soldering, or screw bolting).

Said means can also be simply made up of a lower U-shaped housing capable of receiving an edge of the strip.

It is also possible to add an upper U-shaped housing to said lower U-shaped housing into which the strip is inserted.

To allow the relative expansion between the strip of glass or the like and the metal structure, the dimensions of said strip are slightly smaller than those of the seat where the strip is received. The empty spaces can be filled with a seal or the like (nylon strips, adhesive tapes or plasters).

Examples of the use of the invention are illustrated in the enclosed schematic drawings, in which:

FIG. 3 shows the cross-section of a further variant;

FIGS. 4 and 5 show variants of the housing for the strip of glass.

Figure 1:
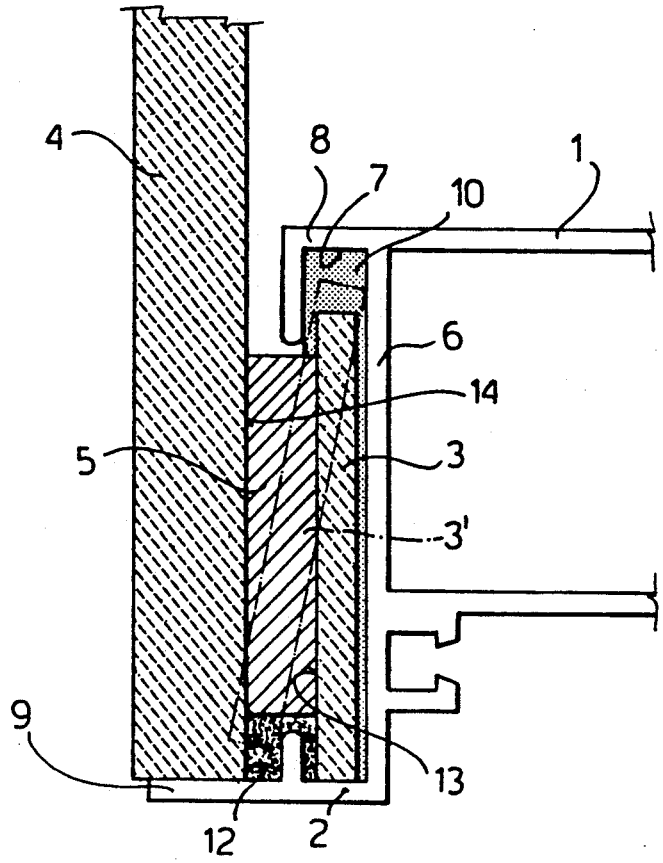
FIG. 1 shows the cross-section of a structure which holds a sheet of single-glazed glass.

In FIG. 1 a portion of section bar 1 is shown forming part of a metal structure capable of holding a sheet of glass covering an entire surface i.e. a structural surface. The part of section bar 1 along its wall 6 facing the sheet of glass 3 is foreseen with two opposite housings 2 and 8, which form together a C-shaped internal seat 7 the rear side of which is the wall 6 itself. The housings 2 and 8 hold a strip 3 of glass or the like which fits loosely in the seat 7, which in turn is filled with lining, nylon strips, adhesive tapes, plasters, or seals (10). A sheet of glass 4 is placed parallel and at a distance to the strip 3 by an elastic seal 5 as explained. The sheet of glass 4 and the strip 3 have areas of facing surfaces, respectively 14 and 13 joined by the elastic seal (5). The weight of the sheet of glass 4 is supported by a jutting ledge 9. In some cases this ledge can be superfluous. Clearly, both or one or the other of the two housings 2 and 8 can be carried out by other blocking means, for instance staples or the like.

The described device is a device capable of effecting the coupling of metallic structure to sheets 4 of glass of whatever type and size.

The insertion of the strip 3 and its engagement to the section bar 1 can come about, for example, as shown with a dotted line in FIG. 1 by driving from underneath a strip 3 into the housing 8 (see position 3'); then the strip can be rotated so as to stand vertically, and is let to fall into the housing 2 where it is held permanently. It is also possible to insert the strip 3 of glass or the like in a longitudinal way into the cavity provided in the four perimetrical section bars which form the window, before the formation of the frame itself. The strip of glass 3 is thus mechanically fixed to the section bar. The strip of glass 3 can now be made fast, using an elastic means 10, for example silicon seal or the like or else by using nylon strips, adhesive tapes and plasters.

In any case the strip 3 is then fixed to the sheet 4 with an elastic means 5.

Figure 2:
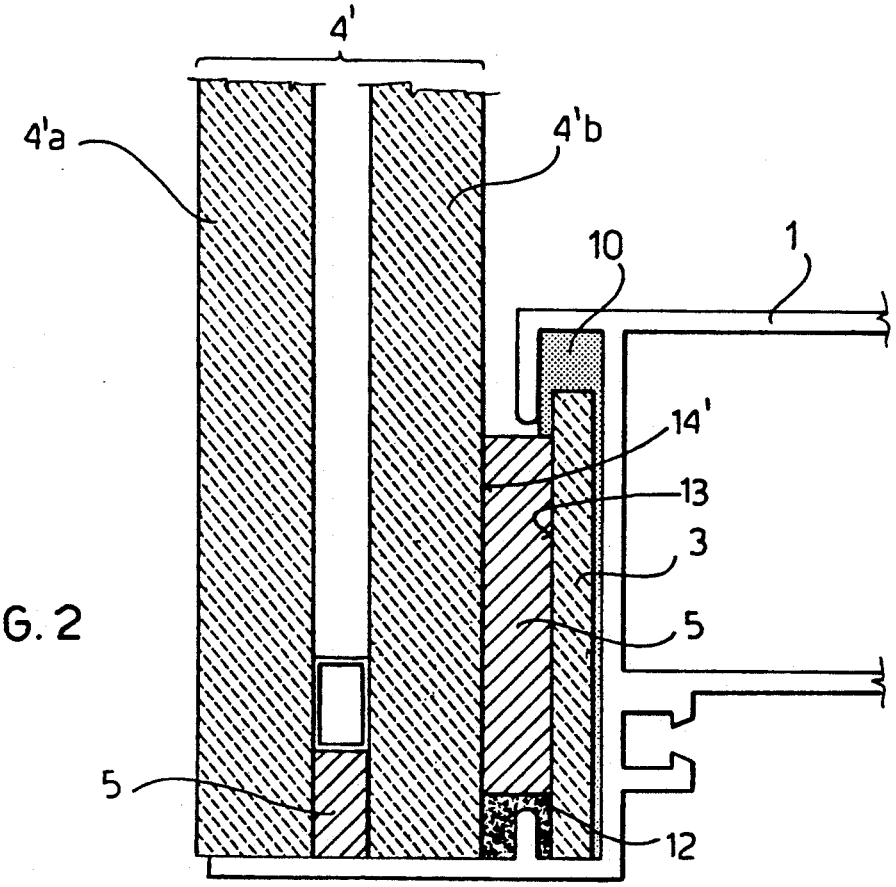
FIG. 2 shows the cross-section of a structure which holds a sheet of double-glazed glass.

In FIG. 2 a device similar to FIG. 1 is shown wherein the section bar 1 is joined to a strip 3 of glass or the like, (as previously explained), then a plate of double-glazing 4'—in which the two sheets of glass 4'a and 4'b that make up the insulating double-glazing 4'—is coupled to the strip 3 as previously explained, i.e. using the same elastic seal 5.

The resulting assembly can warp and spring when subjected to thermal and mechanical stresses, without stressing any component, thanks to the loose fitting and to the presence of the lining or of the sealing 10 between the strip of glass 3 and its seal 7 formed between the housings 2 and 8. In the example illustrated, apart from the seal 5, filling material 12 can be seen between the areas of facing surfaces 14 and 13 of the sheet 4 and of the strip 3.

In FIG. 3 a section bar 21 is shown provided, towards the outside, with a housing 20 capable of receiving and retaining the strip of glass 3. The sheet of glass 4' will be placed in such a way that at least one 14' of its edges will be facing, but at a distance from, the strip 3. Then a filling material 22 will be inserted in the area where the sheet of glass is facing the housing 20, then the elastic fixing means 5, for example silicon seal will be applied.

Obviously the amount of elastic means 5 and the surface which sticks to it is calculated on the basis of the size of the glass, its thickness and the wind pressure, etc.

Finally in FIGS. 4 and 5 two different housings are shown, respectively 17 and 27, which can be foreseen in a metal section bar 21 in order to receive a strip of glass which has a considerable thickness.

I claim:

1. A process for attaching a sheet of glass (4, 4') to a metal structure (1, 21), comprising mechanically fixing at least one strip of glass (3) to the metal structure (1) in such a way that it faces outwards, positioning a sheet of glass (4) in front of said strip (3) so that at least a localized zone (14, 14') is facing, but at a distance from said strip (3), then inserting an elastic fixing means (5) between facing surfaces (13, 14) of said strip (3) and said sheet of glass (4), capable of sticking to both the facing surfaces.

2. A process according to claim 1, wherein there are at least two strips (3) of glass for each sheet of glass (4, 4'), placed along the periphery of the sheet.

3. A process according to claim 1, wherein the sheet of glass (4) rests on a ledge (9) jutting out from the metal structure (1, 21).

4. A process according to claim 1, wherein the strip of glass is fastened to the metal structure before completion of the assembly of the metal structure itself.

5. An assembly of a sheet of glass (4, 4'), a strip of glass and a metal structure (1, 21), wherein said metal structure (1, 21) comprises mechanical retaining means (2, 8) retaining said strip (3) of glass, said strip of glass being parallel to and immediately adjacent said sheet of glass, and elastic means (5) that is disposed between said strip of glass and said sheet of glass and that sticks both to the sheet of glass (4) and to the strip (3) of glass retained by said retaining means (2, 8, 20).

6. An assembly according to claim 5, wherein the retaining means are made up of at least one lower housing (2, 20) receiving the strip (3).

7. An assembly according to claim 6, wherein apart from a U-shaped lower housing (2) a U-shaped upper housing (8) is provided, the strip (3) of glass being loosely fitted within said housings, said housings comprising said mechanical retaining means.

8. An assembly of a sheet of glass to a metal structure, wherein between said sheet of glass and said metal structure there is at least one strip (3) of glass which is mechanically retained on one side to the metal structure (1, 21) and on another side attached by means of an elastic fixing means to the sheet of glass (4, 4').

9. An assembly according to claim 8, wherein in order to allow the insertion of the strip (3) of glass in the metal structure (1) said structure has a U-shaped housing (2, 8) having such a size to also allow the oblique insertion of the strip (3).

10. An assembly according to claim 8, wherein empty spaces (7, 8, 2) between the strip of glass (3) and the metal structure (1, 21) are filled with sealing means (10, 12, 22).

* * * * *